United States Patent [19]

Angelbeck et al.

[11] Patent Number: 4,667,948

[45] Date of Patent: May 26, 1987

[54] APPARATUS FOR ISOLATING OFFSET PRINTING PLATES AND REMOVING INTERMEDIATE PAPER LAYERS

[75] Inventors: Rolf Angelbeck, Kiel; Reinhard Gesell, Schonkirchen; Helmut Greve, Neumunster; Ulrich Henke, Altenholz, all of Fed. Rep. of Germany

[73] Assignee: Dr.-Ing. Rudolf Hell GmbH, Fed. Rep. of Germany

[21] Appl. No.: 793,544

[22] Filed: Oct. 31, 1985

[30] Foreign Application Priority Data

Nov. 9, 1984 [DE] Fed. Rep. of Germany ..... 3440909

[51] Int. Cl.[4] ..... B65H 3/08

[52] U.S. Cl. ..... 271/98; 271/105

[58] Field of Search ..... 271/9, 97, 98, 105

[56] References Cited

U.S. PATENT DOCUMENTS

| | | | |
|---|---|---|---|
| 3,504,910 | 4/1970 | Spyropoulos | 271/98 |
| 3,508,479 | 4/1970 | Hakamata et al. | 95/11 |
| 3,627,308 | 12/1971 | Stoever | 271/26 |
| 4,049,255 | 9/1977 | Stange et al. | 271/9 |
| 4,082,455 | 4/1978 | Brigham | 355/100 |
| 4,141,457 | 2/1979 | Nocek | 214/1 |
| 4,375,285 | 3/1983 | Dennhardt | 271/98 |
| 4,402,592 | 9/1983 | Schon et al. | 355/3 |

FOREIGN PATENT DOCUMENTS 3132393 10/1982 Fed. Rep. of Germany .

*Primary Examiner*—Richard A. Schacher

*Attorney, Agent, or Firm*—Hill, Van Santen, Steadman & Simpson

[57] ABSTRACT

Offset printing plates are usually supplied from the manufacturer as a plate stack with intermediate paper layers. For further processing, the plate stack is placed in a magazine cassette. A suction plate lifts a top plate off from the stack and, after removal of the intermediate paper layer by means of blowing air, conducts it for further processing. Also by means of blowing air, the respective upper plates of the remaining stack are isolated, so that they no longer firmly adhere to the stack. Undesired dislocations of the plates thus arising are mechanically corrected.

11 Claims, 4 Drawing Figures

APPARATUS FOR ISOLATING OFFSET PRINTING PLATES AND REMOVING INTERMEDIATE PAPER LAYERS

BACKGROUND OF THE INVENTION

The invention relates to an apparatus by means of which plates input as a stack are isolated in modern processing machines for offset printing plates such as, for example, exposure machines, and wherein intermediate paper layers which are usually present are removed.

There is a desire in modern machines of the graphics trade, particularly in exposure machines for offset printing plates, to individually remove the plates from a magazine. The unexposed offset plates are normally supplied in packages of 50 to 100 articles, whereby the individual plates are protected by intermediate layers of thin paper due to their sensitive surface. Insofar as possible, the plate stack should be inserted into the magazine in the same way in which it was removed from the outer packaging. From the magazine, the plates should be individually removed, for instance by means of a suction plate or gripper, and should then be supplied for further processing.

This operation, which may seem rather simple at first, is complicated by a number of conditions in view of current practices.

The light-sensitive layer side of the plates is extremely sensitive to scratches. The plates, therefore, dare not slide on other surfaces, for instance parts of the conveyor means, or on one another in any situation.

In the condition in which they are delivered, the plates are usually separated from one another by intermediate layers of paper so that they cannot rub against one another. This intermediate paper layer, however, must be respectively removed after a plate is taken from the stack.

In the condition in which they are delivered, the plates of the stack adhere greatly to one another. In order for the uppermost plate to be reliably taken from the stack without disruption, it is necessary to first loosen it from the plate stack by means of an isolating operation.

Plates having different formats should be processed with one and the same magazine.

The lifting element should always grasp the individual plates in the same position.

SUMMARY OF THE INVENTION

An object of the present invention is to specify an apparatus which meets all of the above conditions.

According to the invention, a cassette means is provided for containing the stack of plates, the cassette means having at least one open end. A vacuum suction plate means is positioned over the stack for lifting an upper-most plate from the stack. Means for lifting the suction plate means is provided such that in a first work phase a channel having a rectangular cross section is opened between an underside of the lifted, upper-most plate and a top of the remaining plate stack. Adjustment means are provided for laterally limiting the channel given differing plate formats. At least two detent pins are positioned such that an end face of the plate stack abuts thereagainst when inserted into the apparatus. The detent pins are hollow and have vertically situated radial slots facing the adjacent plate stack. The detent pins have means for permitting blowing air to be blown from the detent pin slots against the end face of the plate stack and into the channel. Resilient caps which partially cover the slots are situated on the detent pins. Means are provided coupled to the suction plate for actuating the resilient caps. The means for lifting, in a second work phase, lifts the suction plate sufficiently so that it stands free from the cassette on all sides. At least one movable pin is situated in a floor of the cassette at a side of the plate stack opposite the detent pins. Means are provided for pivoting the movable pin away such that it lies beneath the cassette floor.

DESCRIPTION OF THE PREFERRED EMBODIMENTS

Figure 1:
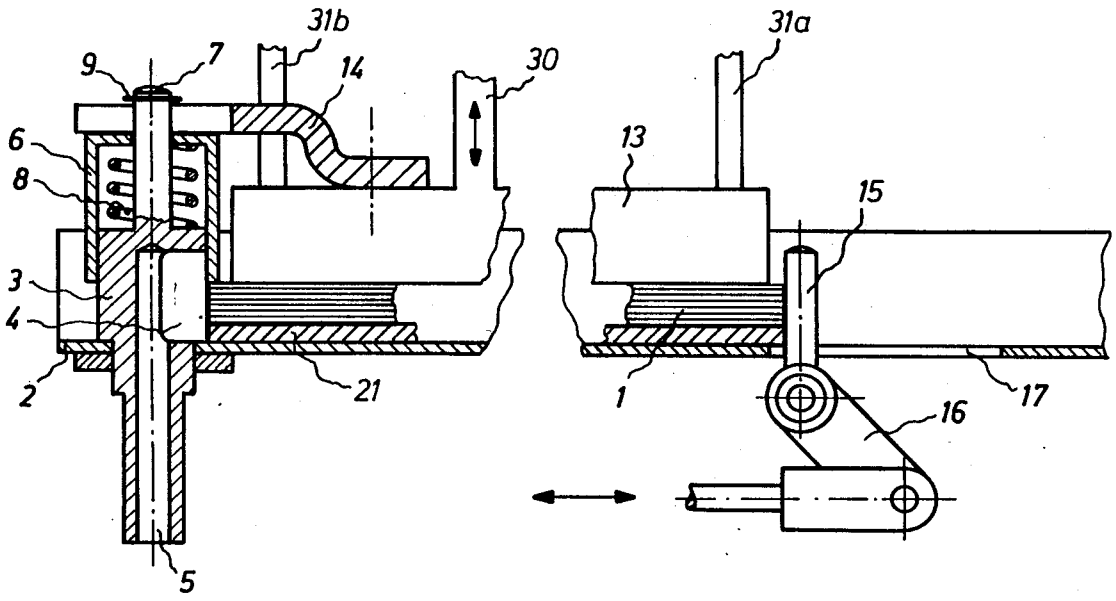
FIG. 1 is a side view of the apparatus of the invention with a suction plate applied.

After being removed from their outer packaging, the unexposed offset printing plates with intermediate paper layers are inserted as a plate stack 1 into a box-shaped cassette with open end faces. At least two detent pins 3 are screwed into the cassette floor at one of the open end faces, the plate stack 1 being applied against these detent pins. The detent pins 3 are hollow-bored and comprise a vertical slot 4 in the direction toward the plate stack 1. Blowing air supplied from below at 5 is capable of being blown against the end face of the plate stack 1 from this vertical slot 4. Proceeding from above, a cap 6 slides on a guide 7 over the slotted part of the detent pins 3, this pressing upward against a detent 9 in its idle position on the basis of a spring 8. When the cap 6 is pressed down, it partially covers the slot 4.

Figure 3:
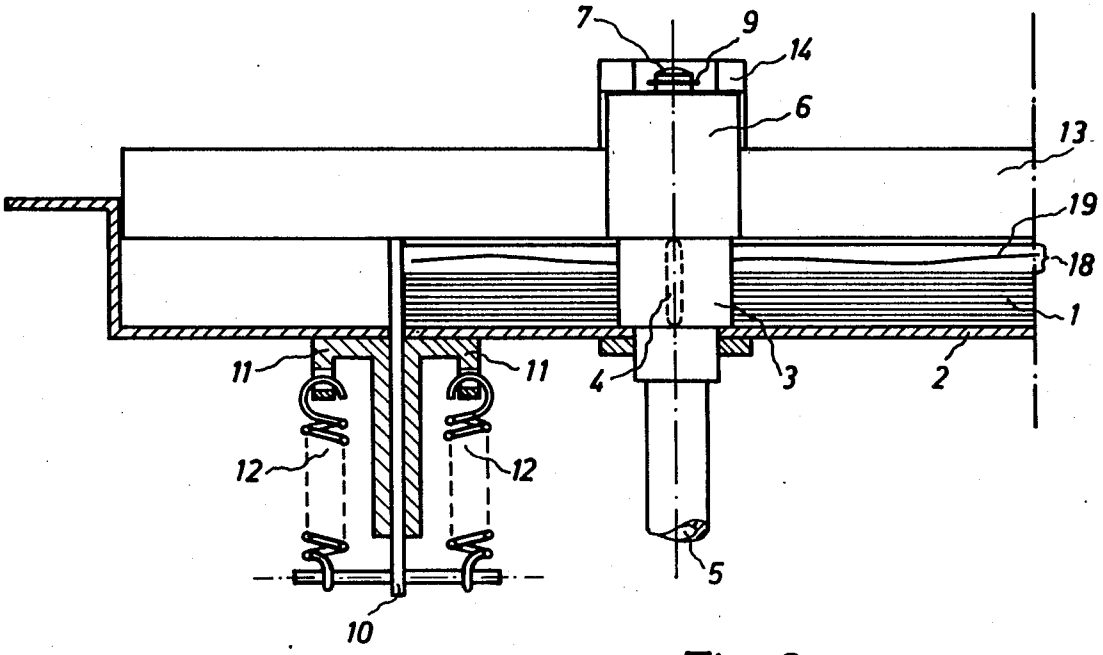
FIG. 3 illustrates resilient partitions in the apparatus of FIGS. 1 and 2.
Figure 4:
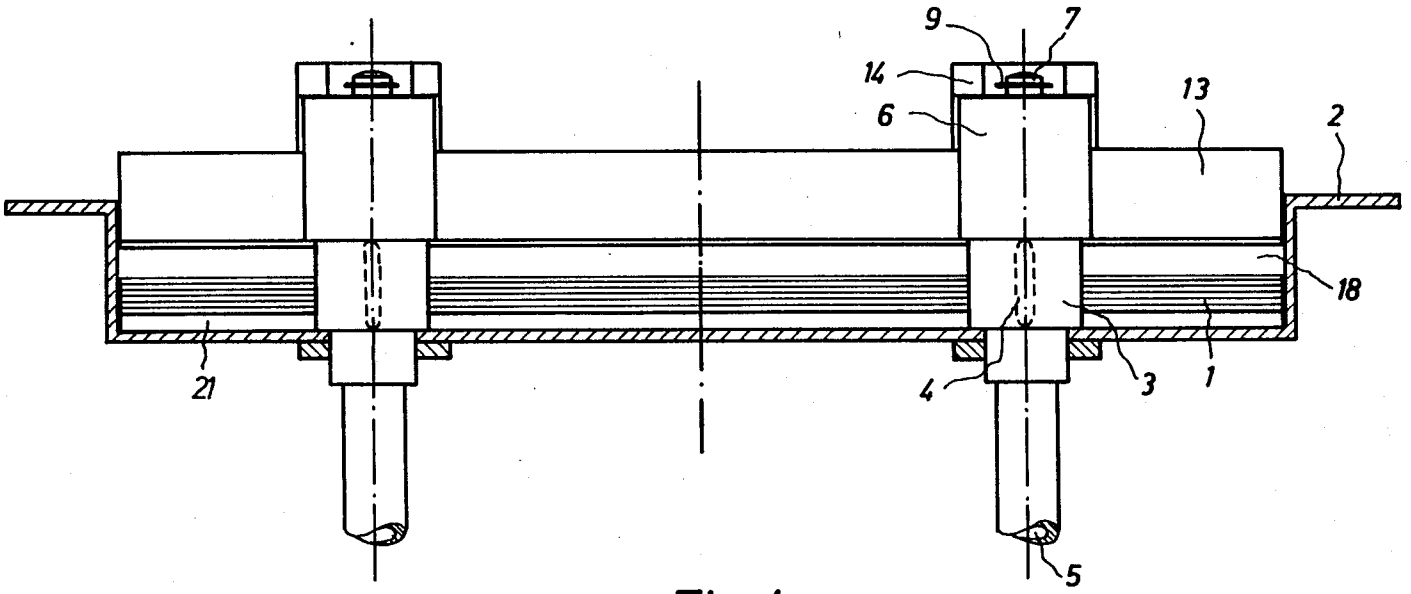
FIG. 4 is a front elevation of the apparatus of FIGS. 1 and 2.

The clearance between the lateral walls of the cassette 2 is kept such that the plate stack having the largest format to be processed just fits in. Resilient sidewalls 10 are situated in the floor of the cassette 2 for smaller formats—as shown in FIG. 3. These are conducted in guides 11 and are drawn up by springs 12. Given larger plate formats, they are pressed down under the weight of the plate stack until their upper edge is flush with the floor of the cassette. The spacing between these resilient side walls is also adapted to the respective plate format.

A suction plate 13 having an engageable and disengageable vacuum is situated above the cassette 2 on guides 31*a*, 31*b* in a movable fashion. Among other things, these guides allow the suction plate 13 to lower via a control rod 30 onto the plate stack 1 in a precisely defined position and also allow it to assume defined distances from the plate stack 1 in a vertical direction as well. Fork-shaped detents 14 are situated on the upper side of the suction plate 13 such that they press against the upper side of the caps 6 when the suction plate 13 is lowered and press these caps 6 against the spring 8. The lower edges of the caps 6 cover the slots 4 to a greater or lesser degree. The degree of coverage is determined by the height of the remaining plate stack 1 when the suction plate 13 lowers down onto the plate stack.

Pivotably situated pins 15 are further situated in the floor of the cassette 2 such that, in the vertical position, they press against that narrow side of the plate stack 1 which lies opposite the detent pins 3. These pins 15 can be pivoted by means of a lever mechanism 16 so that they disappear through slots 17 in the cassette floor, and thus disappear below the level thereof.

The functioning of the apparatus is as follows.

As shown in FIG. 1, the suction plate 13 is lowered down onto the plate stack 1. The detents 14 press against the springs 8 and thus press the caps 6 down. The pins 15 are situated in the vertical position. After the vacuum is switched on in the suction plate 13, this vacuum seizes the uppermost plate of the stack. After this, the suction plate 13 is lifted a few millimeters together with the uppermost plate held by suction (FIG. 2), so that a flat channel 18 opens between the underside of the lifted plate and the remaining stack. This flat channel 18 is laterally limited by the side walls of the cassette 2 and by the respective, resilient side walls 10, given smaller plate formats. Due to the detents 14, the caps 6 proceed into such a position that the slots 4 in the detent pins 3 are covered such that they terminate exactly with the upper edge of the channel 18. After the pins 15 are pivoted away by the lever mechanism 16, the detent pins 3 are supplied with blowing air proceeding from the air supply 5. This emerges from the slots 4 and blows into the opened channel 18 and against the end face of the plate stack 1. The use of blowing air is as low as conceivably possible because this can only freely emerge from the slots 4 at the level of the opened channel 18. The remaining slot is substantially closed by the plate stack 1. Given an appropriate dimensioning of the height of the channel 18 and the quantity of blowing air, the following occurs.

Figure 2:
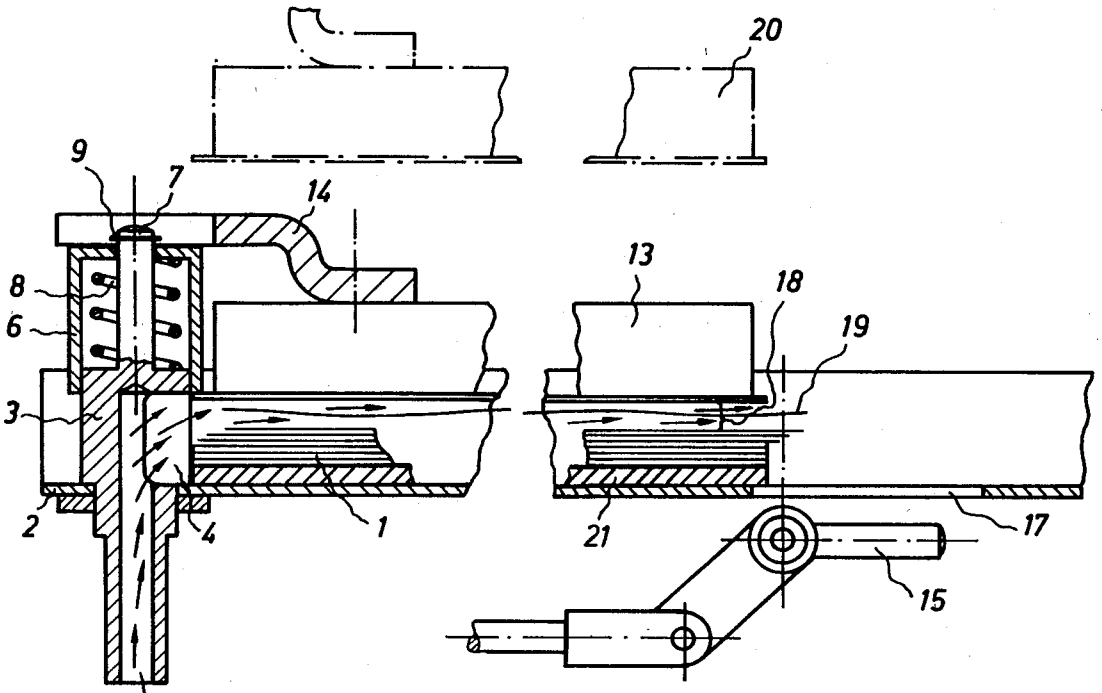
FIG. 2 is a side view of the apparatus of the invention with a blowing channel open.

An intermediate paper layer 19 usually lying between the individual plates of the stack, and serving to protect the surface thereof, slides in the direction of the air stream, guided by the lateral walls. It slides out between the lifted plate and plate stack, and is conducted into a collecting container via a channel, which is not shown here. The air stream also penetrates from the end face of the plate stack between the plates lying at the top. These are slightly lifted off from one another, i.e. "isolated". Only after this is the following, undisturbed lifting of the next plate by the suction plate 13 possible because the individual plates usually adhere greatly to one another when the stack is delivered. In the described isolating operation, it occurs that the uppermost 3 or 4 plates dislocate slightly in the direction of the air stream, as shown in FIG. 2. They must be returned into the exact position (detent against the detent pins 3) because the further processing of the plates requires that these are always seized by the suction plate 13 in the same position and are later also exactly deposited. After the intermediate paper layer 19 has been blown out, the isolation of the uppermost plates of the stack has been carried out and the blowing air has been shut off, the suction plate 13 is therefore further lifted into a position 20 (FIG. 2). The pins 15 are now pivoted back into the vertical position by means of the lever mechanism 16. The dislocated uppermost plates thus shift against the detent pins 3 into their correct initial position. The suction plate 13 conducts the seized plate away (for instance laterally) for further processing via guides 31*a*, 31*b*, deposits it elsewhere when the vacuum is disconnected, and returns into the position 20 shown in FIG. 2. After the suction plate 13 is lowered onto the plate stack 1, the operation begins anew, as described, on the basis of executive sequencing.

The invention is not limited only to application given offset plates. On the contrary, it can be employed anywhere where materials such as films, foils, plates or the like with protective intermediate layers of paper or similar material are supplied as a stack to be individually moved from a magazine together with removal of the intermediate layer. They are then supplied for further processing.

Although various minor changes and modifications might be proposed by those skilled in the art, it will be understood that we wish to include within the claims of the patent warranted hereon all such changes and modifications as reasonably come within our contribution to the art.

We claim as our invention:

1. An apparatus for isolating individual offset printing plates lying in a stack and for removing intermediate paper layers between the individual plates, comprising:

a cassette means for containing the stack of plates, the cassette means being in a shape of an upwardly open box with at least one open end;

a vacuum suction plate means positioned over the stack for lifting an uppermost plate from the stack;

means for lifting the suction plate means sufficiently such that in a first work phase a channel having a rectangular cross section is opened between an underside of the lifted uppermost plate and a top of the remaining plate stack;

adjustment means for laterally limiting said channel given differing plate formats;

at least two detent pins being positioned such that an end face of the plate stack abuts thereagainst when inserted into the apparatus;

said detent pins being hollow and having vertically situated radial slots facing the adjacent plate stack, the detent pins having means for permitting blowing air to be blown from the detent pin slots against the end face of said plate stack and into said channel;

resilient caps which partially cover said slots being situated on said detent pins;

means coupled to the suction plate for actuating said caps;

said means for lifting in a second work phase lifting the suction plate sufficiently so that it stands free from the cassette on all sides;

at least one movable pin situated in a floor of the cassette at a side of the plate stack opposite the detent pins; and means for pivoting said movable pin away under an upper side of the cassette floor.

2. An apparatus according to claim 1 wherein said adjustment means for lateral limitation of the channel comprises partitions resiliently situated in the cassette floor.

3. An apparatus according to claim 1 wherein said adjustment means for lateral limitation of the channel comprises lateral displaceable walls of the cassette and means for securing the walls into positions corresponding to the plate format.

4. An apparatus according to claim 1 wherein the means for pivoting pivots the movable pin in a direction leading away from the plate stack when it is pivoted under the upper side of the cassette floor.

5. An apparatus according to claim 1 wherein the cassette means has first and second open ends opposite one another.

6. An apparatus according to claim 1 wherein the resilient caps comprise cylinders receivable over a pin having a channel therein leading to the radial slot, and wherein the cylindrical cap has a spring positioned therein between an upper surface thereof and at least a portion of a top surface of the pin, the pin also having a guide portion extending upwardly through an aperture in a top of the cylindrical cap.

7. An apparatus according to claim 6 wherein a fork-shaped detent arm connects between a top of the cap and the suction plate means.

8. An apparatus according to claim 1 wherein said means for pivoting said movable pin comprises an axle having a lever arm connected thereto, the pin projecting from said same axle, and wherein a push arm is connected to the lever arm.

9. A system for isolating individual offset printing plates lying in a stack and for removing intermediate paper layers between the individual plates, comprising:

a container having an open top and an open end side as an exit region for the paper layers;

a stack of sheets in the container;

a projection in abutment with one end face of the stack opposite the exit region of the container, said projection having an air channel and an air outlet slot in communication therewith, the slot being positioned adjacent the abutting end face of the stack;

a vacuum suction means positioned over a top of the stack;

shutter means on the projection for selectively closing a portion of the slot; and coupling means connecting the shutter means and air suction means so that their movements are mutually coupled to one another.

10. A system according to claim 9 including a movable abutment surface at an end face of the stack opposite the slot, said abutment means in a first aligning position permitting abutment with the end face so as to align offset plates with a top of the stack when such plates are offset at the end face and bring them back into alignment with the stack, and in a second position said abutment surface being away from the end face so as to permit exit of the paper layers from the container.

11. A system according to claim 9 wherein movement means are coupled to the suction plate such that in a first work position and with suction applied an uppermost sheet of the stack is slightly spaced from a top of the stack so as to form an air channel from the slot to the exit of the container, and wherein in a second work position the suction plate substantially removes the uppermost sheet from a vicinity of the stack.

* * * * *